US008444435B2

(12) United States Patent
Lee et al.

(10) Patent No.: US 8,444,435 B2
(45) Date of Patent: May 21, 2013

(54) MALE CONNECTOR AND CORRESPONDING FEMALE CONNECTOR

(75) Inventors: Kuo-Ching Lee, New Taipei (TW); Ta-Teh Meng, New Taipei (TW); Jian-Li Guan, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 13/355,948

(22) Filed: Jan. 23, 2012

(65) Prior Publication Data

US 2012/0238148 A1 Sep. 20, 2012

(30) Foreign Application Priority Data

Mar. 14, 2011 (CN) ..... 2011 1 0059837

(51) Int. Cl.
*H01R 13/648* (2006.01)

(52) U.S. Cl.
USPC ..... 439/607.07

(58) Field of Classification Search
USPC ..... 439/607.07, 607.11, 607.05, 607.09, 439/607.01
See application file for complete search history.

(56) References Cited

U.S. PATENT DOCUMENTS

| | | | | |
|---|---|---|---|---|
| 7,883,367 | B1 * | 2/2011 | Kline | 439/607.05 |
| 7,955,130 | B2 * | 6/2011 | Liu et al. | 439/607.09 |
| 7,976,340 | B1 * | 7/2011 | Saraswat et al. | 439/607.07 |
| 8,062,065 | B2 * | 11/2011 | Whiteman et al. | 439/607.07 |

* cited by examiner

*Primary Examiner* — Phuong Dinh
(74) *Attorney, Agent, or Firm* — Rahman LLC

(57) ABSTRACT

A male connector has an insulating housing, multiple signal terminals, and multiple grounding modules. The signal terminals are mounted through the insulating housing. The grounding terminal modules are mounted through the insulating housing. Each grounding terminal module is integrally formed into one piece and has multiple grounding terminals. Adjacent grounding terminals are connected integrally to each other so that the grounding terminals of each grounding terminal module are arranged in a line. The integrally formed ground terminal modules reduce a total tolerance of the grounding terminals and increase the production rate of the male connector.

15 Claims, 16 Drawing Sheets

MALE CONNECTOR AND CORRESPONDING FEMALE CONNECTOR

BACKGROUND OF THE INVENTION

1. Field of the Invention

The present invention relates to a connector, and more particularly to a male connector and a female connector corresponding to the male connector. The male connector has multiple sets of grounding terminals and the grounding terminals of each set are integrally formed together to reduce signal interference, decrease the assembling tolerance and improve quality of fabrication and production rate. The female connector is structurally firm to prevent inadvertent disassembly and improve signal transmission stability.

2. Description of Related Art

Printed circuit boards (PCB) are important members for holding electrical components such as chips, capacitors and resistors. To expand functions, some PCBs are connected to additional PCBs through connector assemblies. Such connector assembling for connecting different PCBs has a male connector and a female connector. The male connector is connected to a PCB while the female connector is connected to another so that the two PCBs are connected to each other by engaging the male connector with the female connector. The male or female connector has an insulating housing and multiple signal and grounding terminals mounted on the insulating housing and arranged in arrays.

U.S. Pat. No. 6,171,115 discloses a connector assembly for connecting different PCBs and having male and female connectors. However, each grounding terminal of the male or female connector is manufactured independently and then inserted into the male or female connector. Because each grounding terminal has a tolerance, a total tolerance of a column or row of the grounding terminals in an array is unexpectedly large to cause fabrication failure of the male or female connector.

Furthermore, the female connector has multiple insulating brackets assembled together. However, the engagement between adjacent insulating brackets is weak and infirm so that the structural strength of the female connector is low and insufficient to bear a large pulling force. The durability of the female connector is therefore undesirable.

To overcome the shortcomings, the present invention provides a male connector and a corresponding female connector to mitigate or obviate the aforementioned problems.

SUMMARY OF THE INVENTION

The main objective of the invention is to provide a male connector and a female connector corresponding to the male connector. The male connector has multiple sets of grounding terminals and the grounding terminals of each set are integrally formed together to reduce signal interference, decrease the assembling tolerance and improve quality of fabrication and production rate. The female connector is structurally firm to prevent inadvertent disassembly and improve signal transmission stability.

A male connector in accordance with the present invention comprises an insulating housing, multiple signal terminals, and multiple grounding modules. The signal terminals are mounted through the insulating housing. The grounding terminal modules are mounted through the insulating housing. Each grounding terminal module is integrally formed into one piece and has multiple grounding terminals. Adjacent grounding terminals are connected integrally to each other so that the grounding terminals of each grounding terminal module are arranged in a line. The integrally formed grounding terminal modules reduce a total tolerance of the grounding terminals and increase the production rate of the male connector.

A female connector corresponds to the male connector and comprises a first insulating base, multiple second insulating bases, multiple signal transmission terminal sets and multiple grounding plates. The first insulating base has a bracket having a bottom and multiple assembling slots defined in the bracket and arranged in a row, and a tongue formed on and protruding backward from the bottom of the bracket. The second insulating bases are mounted respectively in the assembling slots of the first insulating base and each second insulating base has a bottom edge, a rear edge and a resilient hook formed on and protruding forward from the bottom edge and hooking in one of the locking holes. The signal transmission terminal sets are mounted respectively on and correspond to the second insulating base and each signal transmission terminal set has multiple signal transmission terminals mounted on the second insulating base and respectively extending in the bracket of the first insulating base. The grounding plates are mounted respectively on and correspond to the second insulating bases, are arranged alternately with the second insulating bases and extend forward in the bracket of the insulating base.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
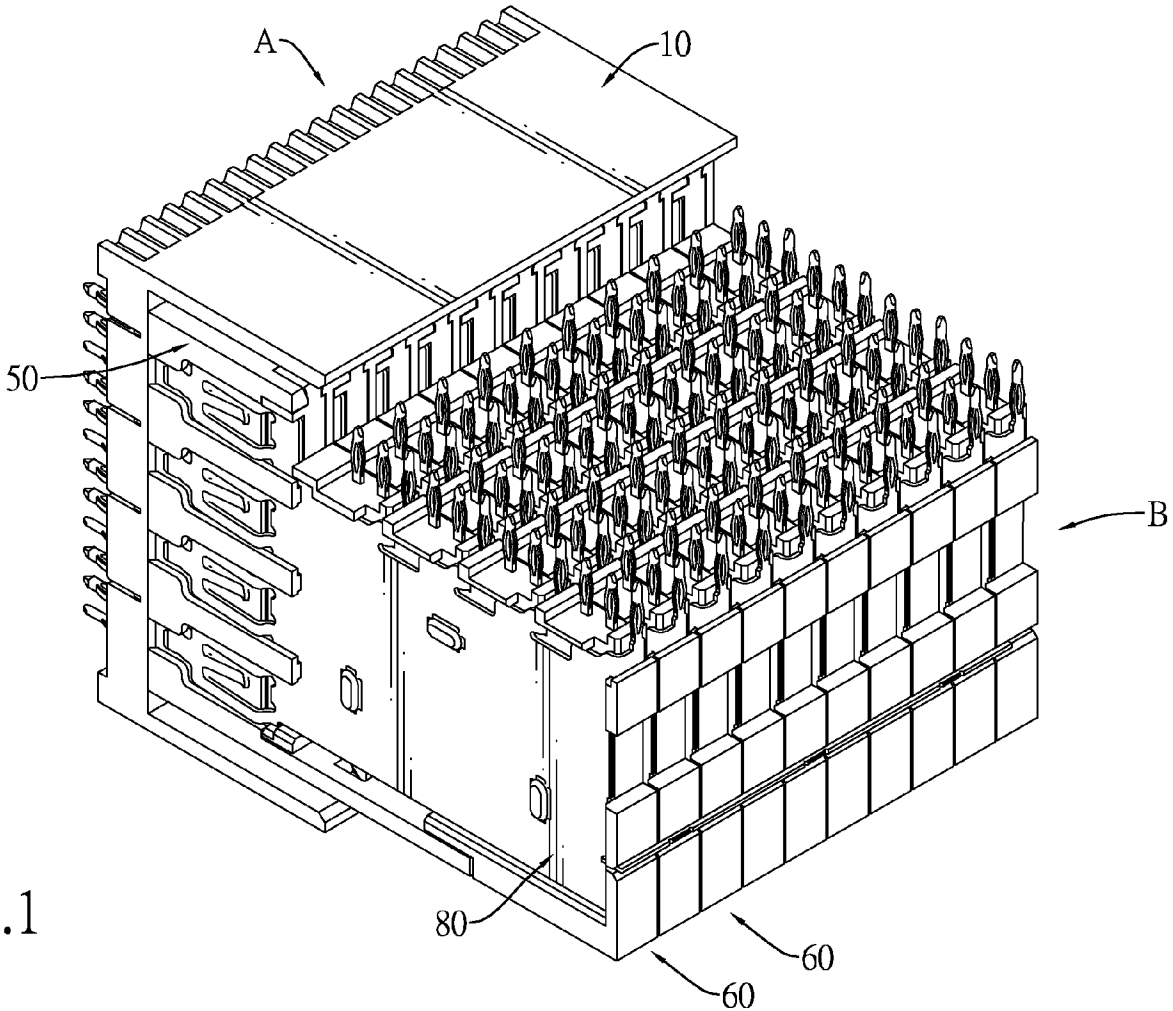
FIG. 1 is a perspective view of a male connector and a female connector in accordance with the present invention.
Figure 2:
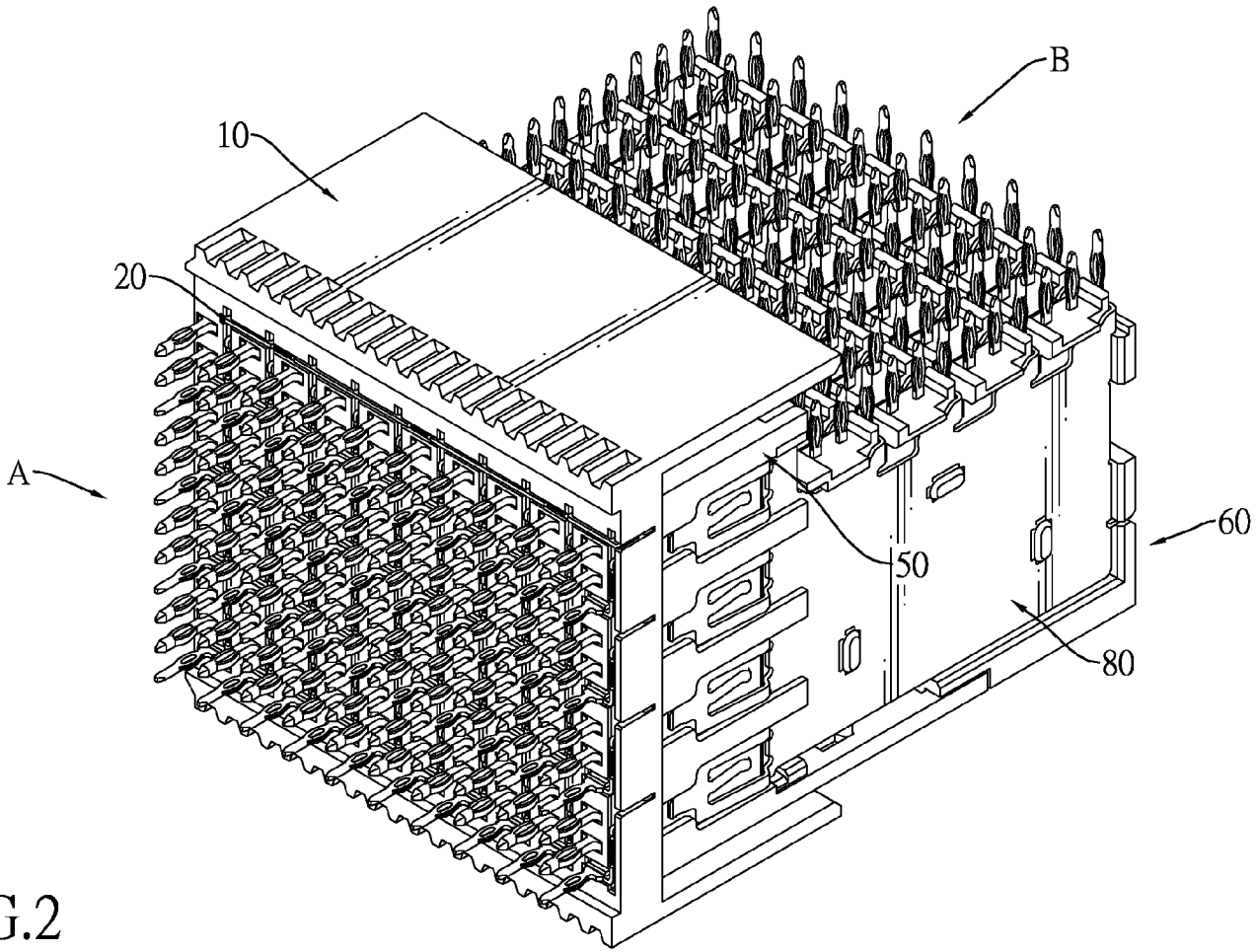
FIG. 2 is another perspective view of the male connector and female connector in FIG. 1.
Figure 3:
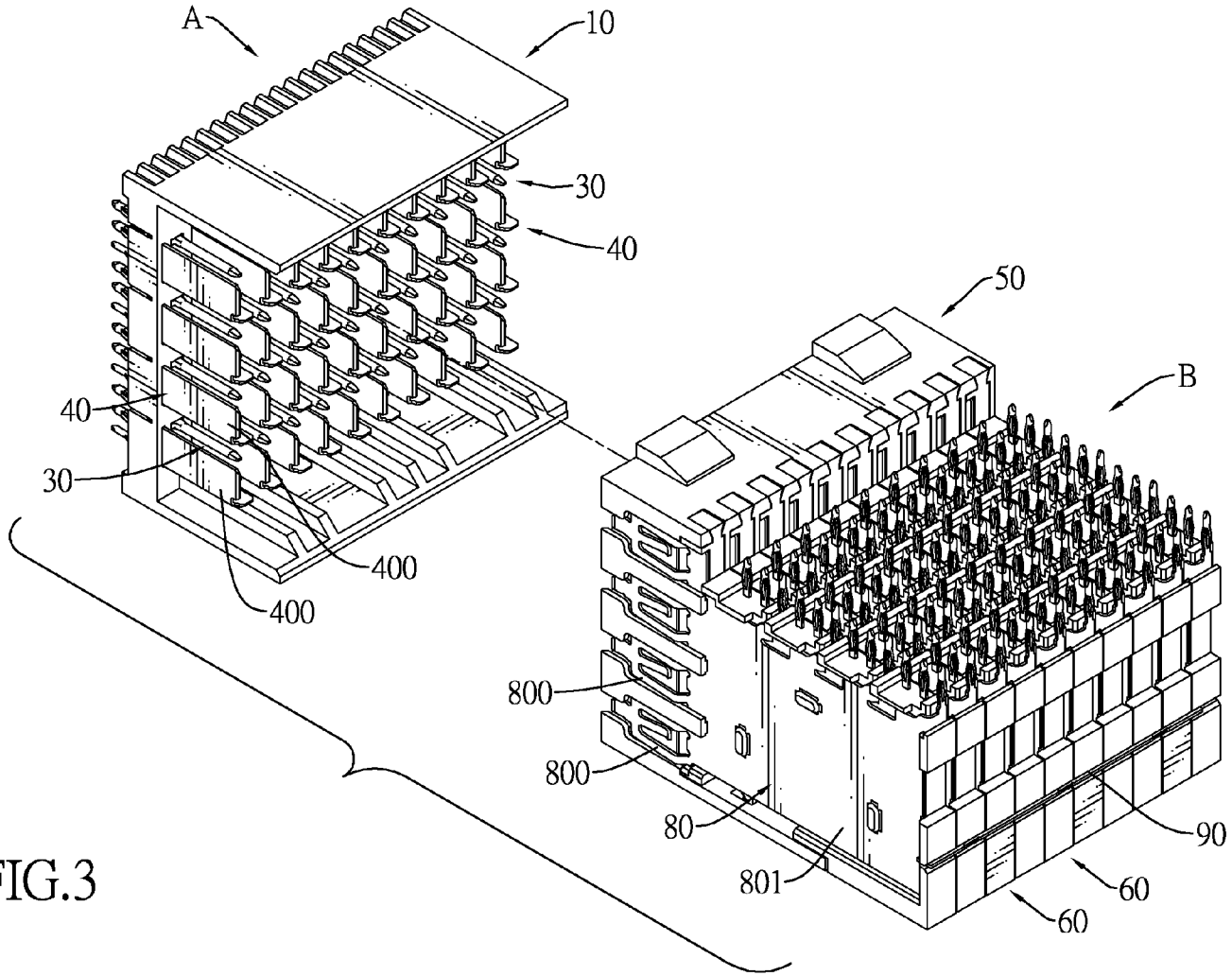
FIG. 3 is an exploded perspective view of the male connector and female connector in FIG. 1.
Figure 4:
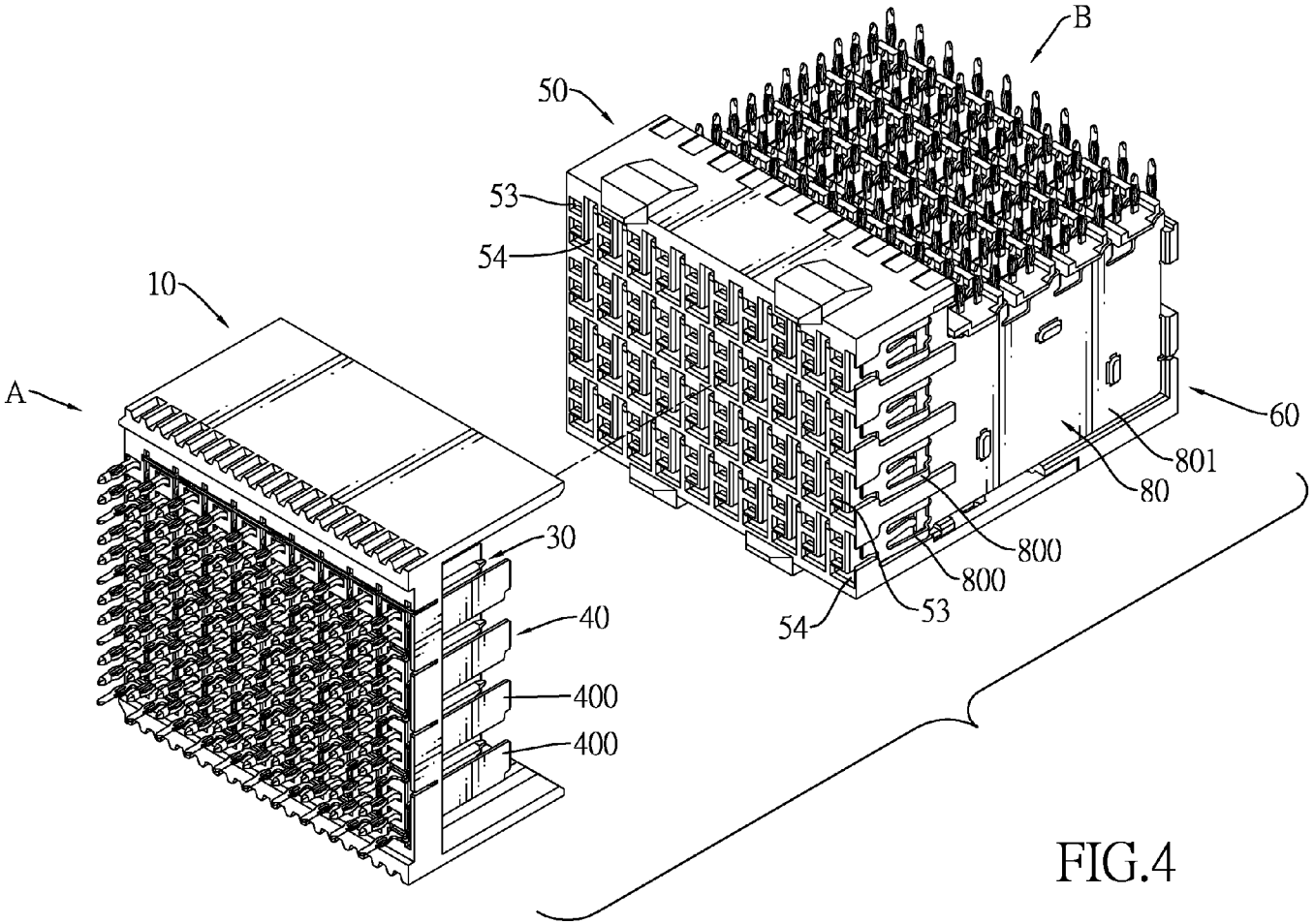
FIG. 4 is another exploded perspective view of the male connector and female connector in FIG. 2.
Figure 5:
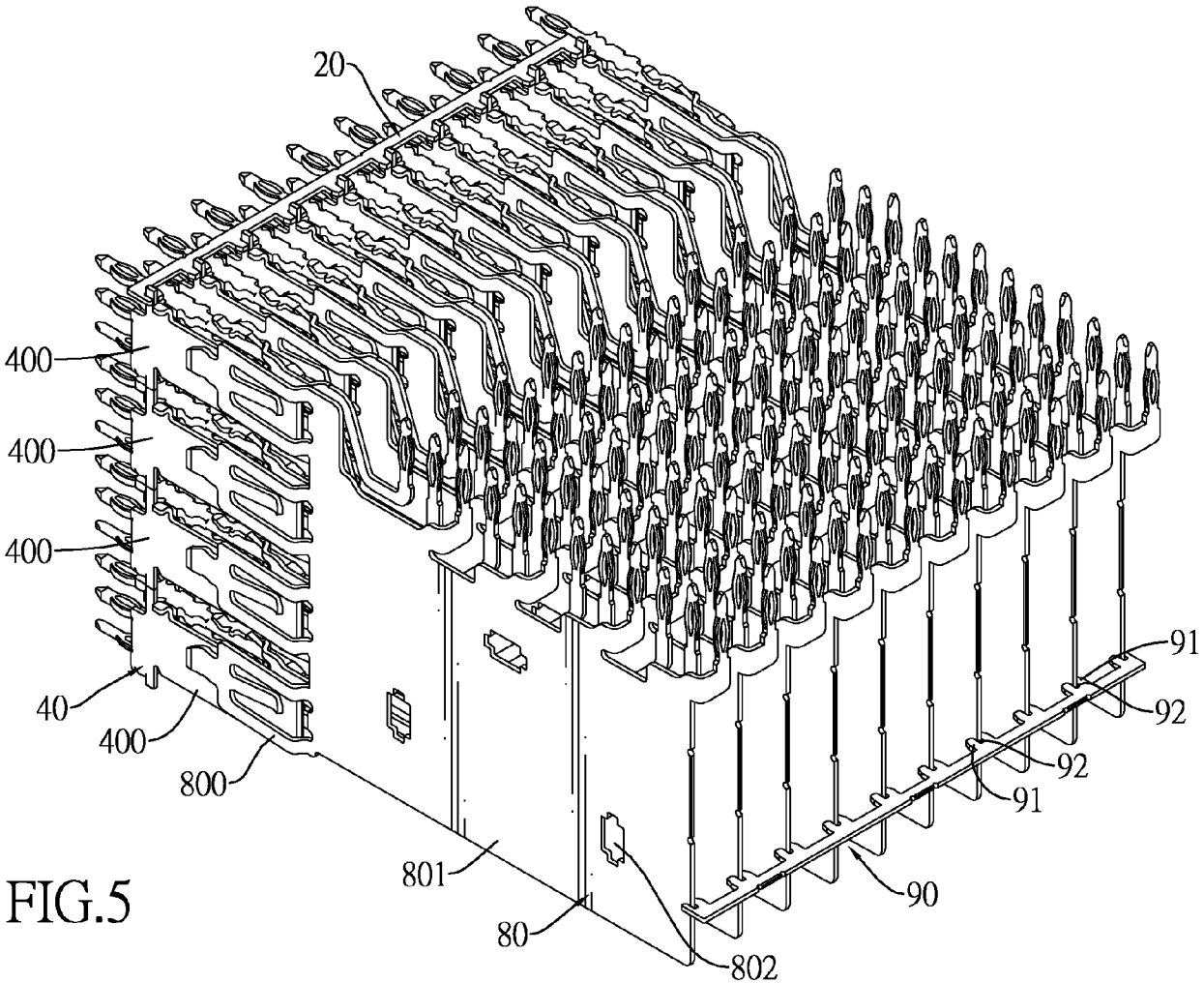
FIG. 5 is a perspective view of the male connector and female connector in FIG. 1 omitting an insulating housing and insulating bases.
Figure 6:
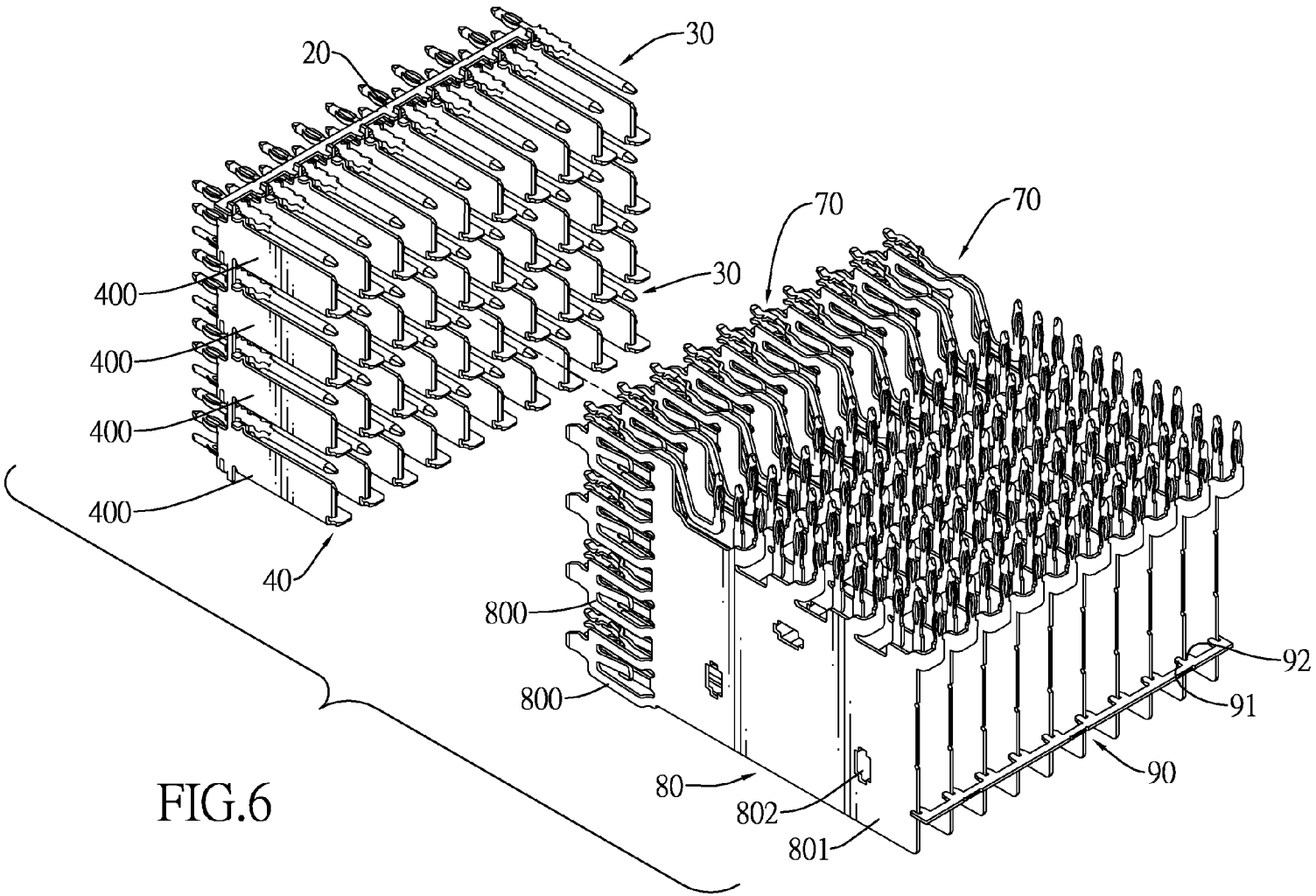
FIG. 6 is an exploded perspective view of the male connector and female connector in FIG. 5 omitting the insulating housing and the insulating bases.
Figure 7:
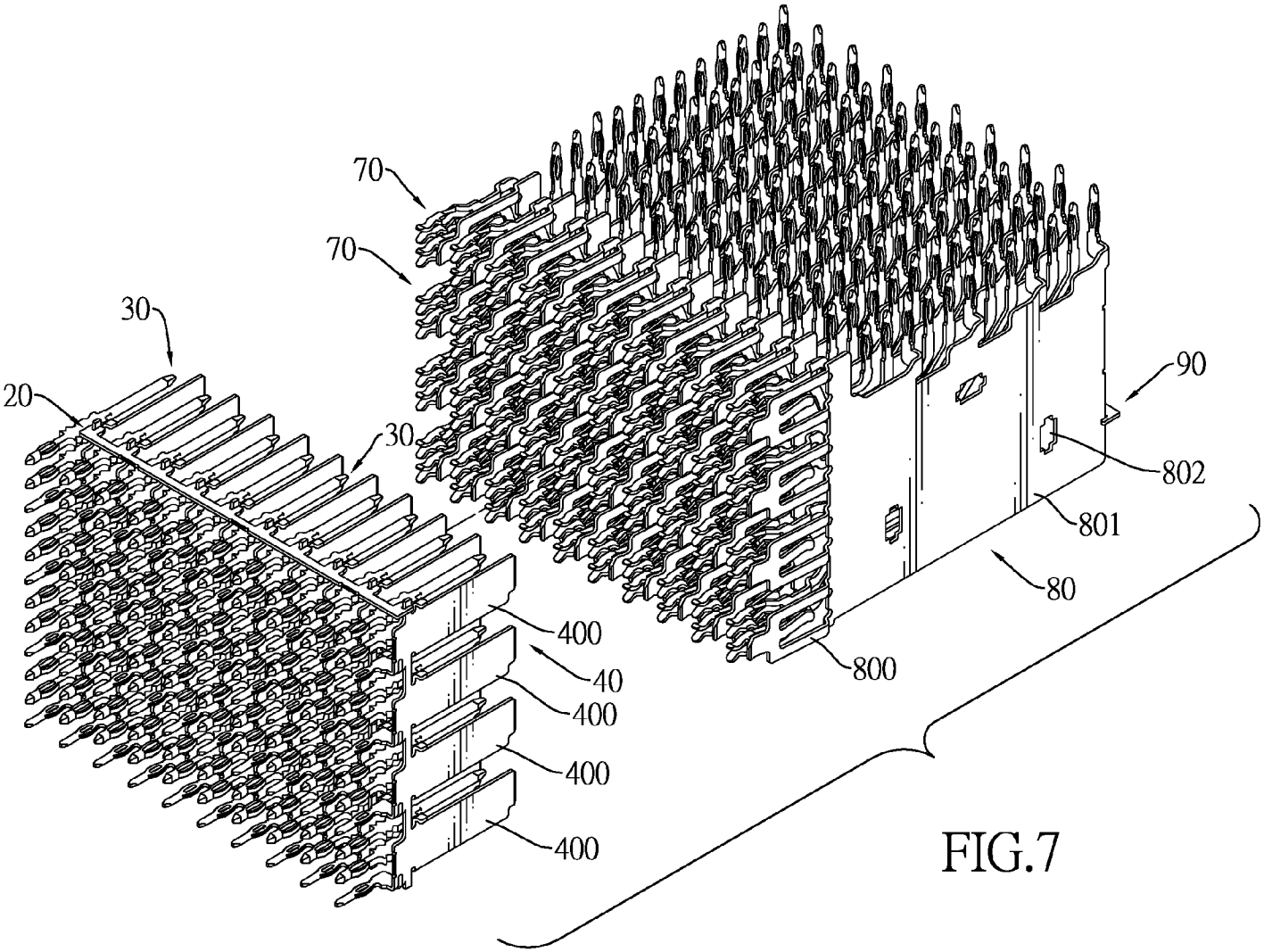
FIG. 7 is another exploded perspective view of the male connector and female connector in FIG. 6 omitting an insulating housing and an insulating bracket.
Figure 8:
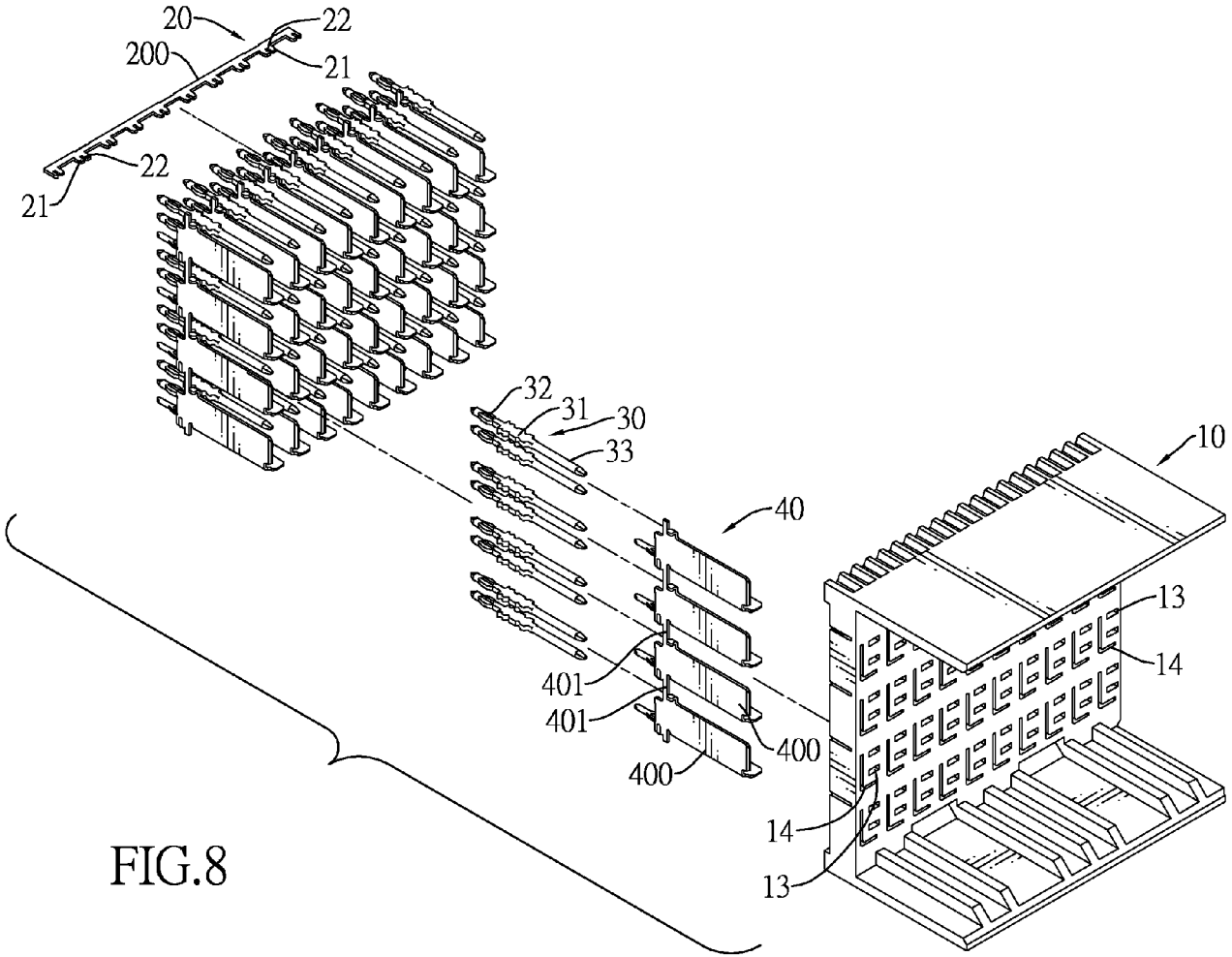
FIG. 8 is an exploded perspective view of the male connector in FIG. 1.

With reference to FIGS. 1 to 6, a male connector A and a female connector B are mounted on different PCBs and detachably engage each other to electrically connect the PCBs.

With further reference to FIGS. 8 to 12, the male connector A comprises an insulating housing 10, multiple signal terminals 30, multiple grounding terminal modules 40 and a supporting crossbar 20.

The insulating housing 10 has a front, a rear, multiple signal terminal holes 13 and multiple grounding terminal holes 14. The signal terminal holes 13 are defined through the insulating housing 10. The grounding terminal holes 14 are defined through the insulating housing 10 and each grounding terminal hole 14 may have an L-shaped cross section and a slit 141 extending transversely from and communicating with the grounding terminal hole 14.

The signal terminals 30 are mounted respectively and longitudinally through and correspond to the signal terminal holes 13, extend out from the front of the insulating housing 10 and are arranged in an array. Each signal terminal 30 has a second mounting section 31, a second press-fitting section 32 and a second contacting section 33.

The second mounting section 31 is mounted in a corresponding signal terminal hole 13 of the insulating housing 10. The second press-fitting section 32 is formed on and protrudes backward from the second mounting section 31. The second contacting section 33 is formed on and protrudes forward from the second mounting section 31.

The grounding terminal modules 40 are arranged abreast, are mounted through the insulating housing 10 and each grounding terminal module 40 is integrally formed into one piece and has multiple grounding terminals 400. Each grounding terminal 400 is mounted longitudinally through one of the grounding terminal holes 14 in the insulating housing 10 and adjacent grounding terminals 400 are connected integrally to each other through a connecting section 401 so that the grounding terminals 400 of each grounding terminal module 40 are arranged in a line such as a row or a column. The grounding terminals 400 of all grounding terminal modules 40 are arranged in an array.

Furthermore, each grounding terminal 400 of each grounding terminal module 40 has a first mounting segment 41, a first press-fitting segment 42 and a first contacting segment 43. The first mounting segment 41 is mounted in one of the grounding terminal holes 14 in the insulating housing 10 and may have a transverse extension segment 411 formed on and protruding transversely from the first mounting segment 14. The first press-fitting segment 42 is formed on and protrudes longitudinally backward from the first mounting segment 41 and may protrude from the transverse extension segment 411. The first contacting segment 43 is formed on and protrudes longitudinally forward from the first mounting segment 41. The first contacting segment 43 has a transverse positioning tab 431 being longitudinal, formed on and protruding transversely from the first contacting segment 43 and mounted in the slit 141 of one of the grounding terminal holes 14 so that the first contacting segment 43 is stably positioned in the corresponding grounding terminal hole 14 without inadvertent movement such as rotation.

The supporting crossbar 20 clamps and connects to all grounding terminal modules 40 and has a bar 200 and multiple clamps 21.

The clamps 21 are formed on the bar 200 and each clamp 21 has a clamping slot 22 defined in the clamp 21 and engaging the connecting section 401 of one of the grounding terminal modules 40.

Figure 9:
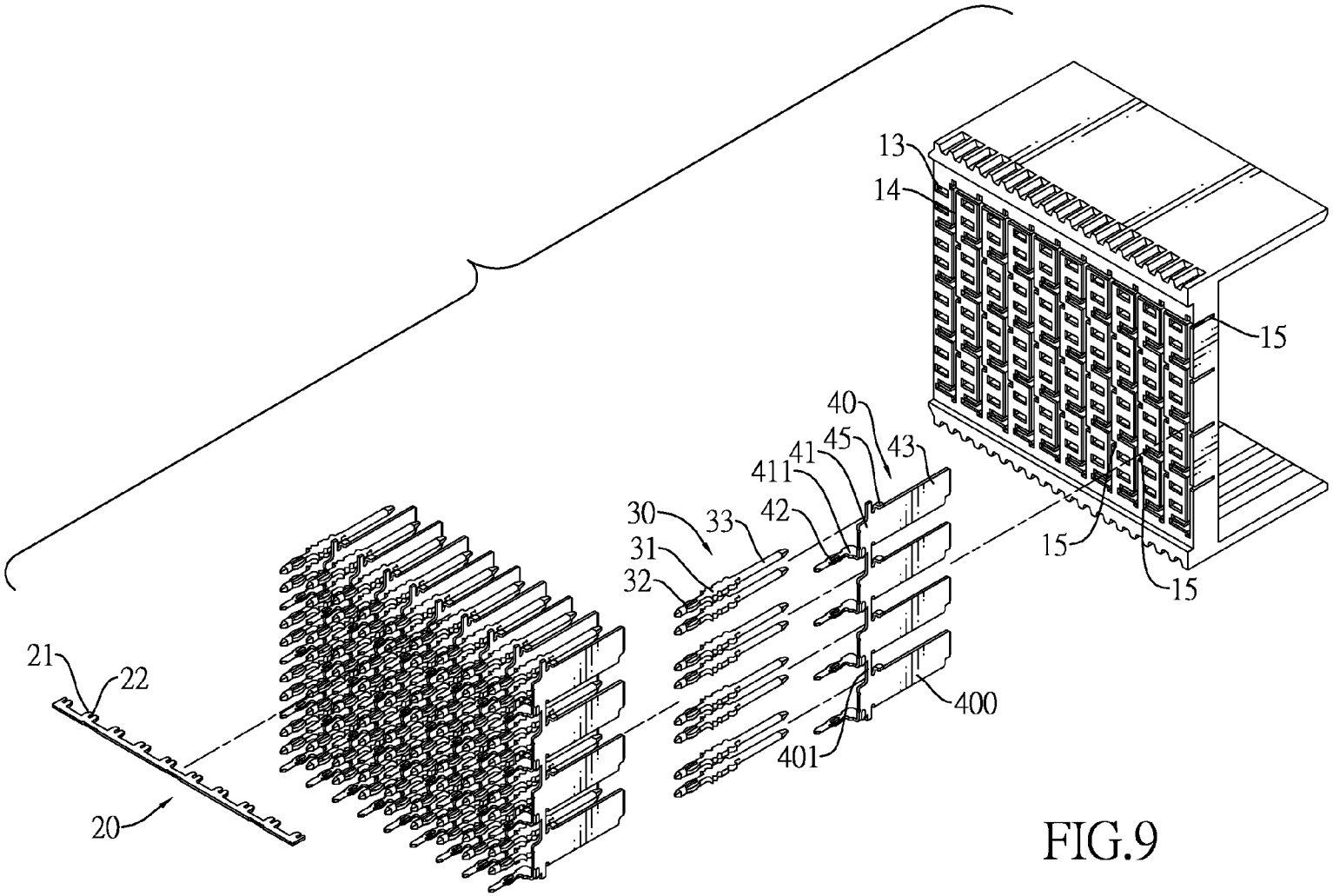
FIG. 9 is another exploded perspective view of the male connector in FIG. 8.
Figure 10:
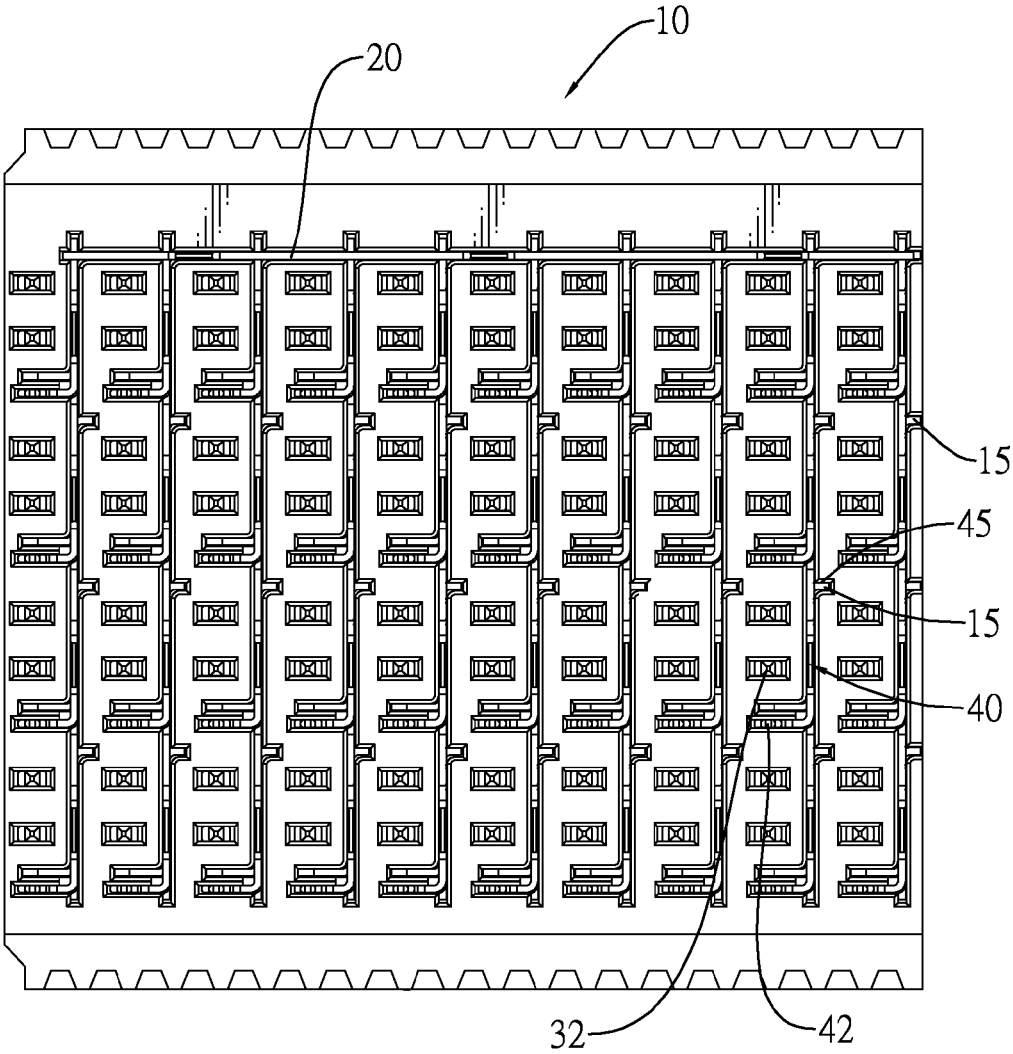
FIG. 10 is a rear view of the male connector in FIG. 1.
Figure 11:
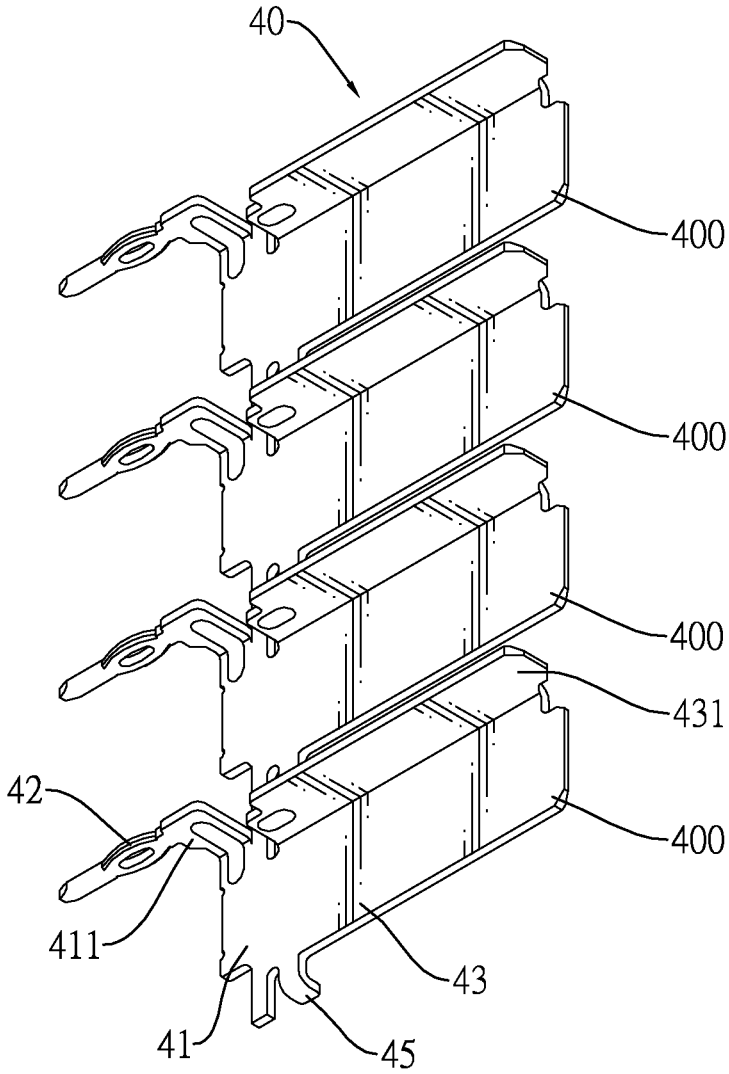
FIG. 11 is a perspective view of a grounding terminal module of the male connector in FIG. 6.
Figure 12:
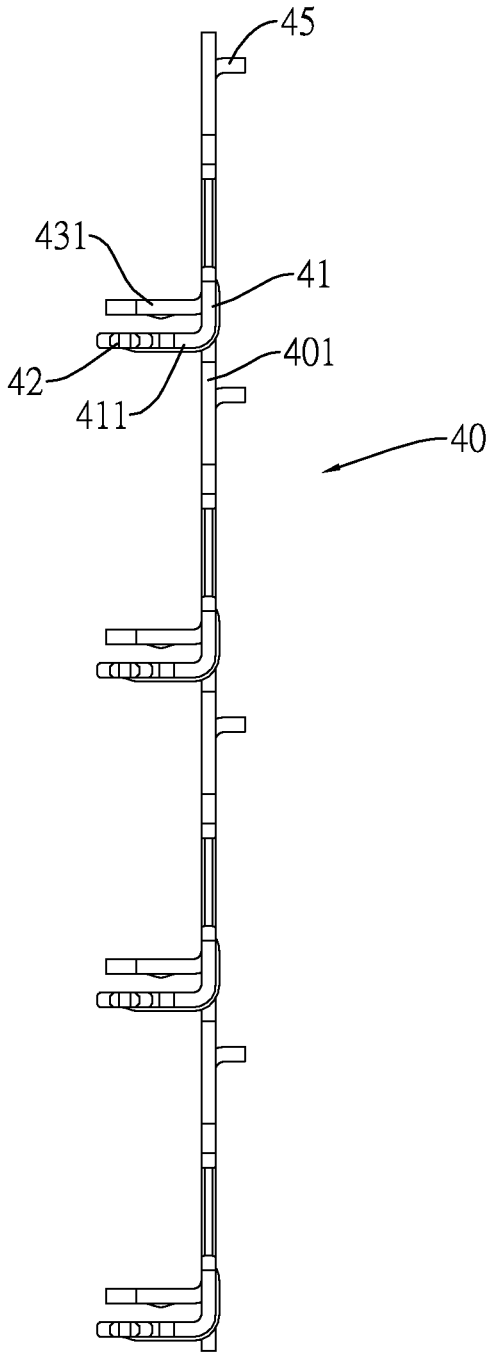
FIG. 12 is an end view of the grounding terminal module of the male connector in FIG. 11.
Figure 13:
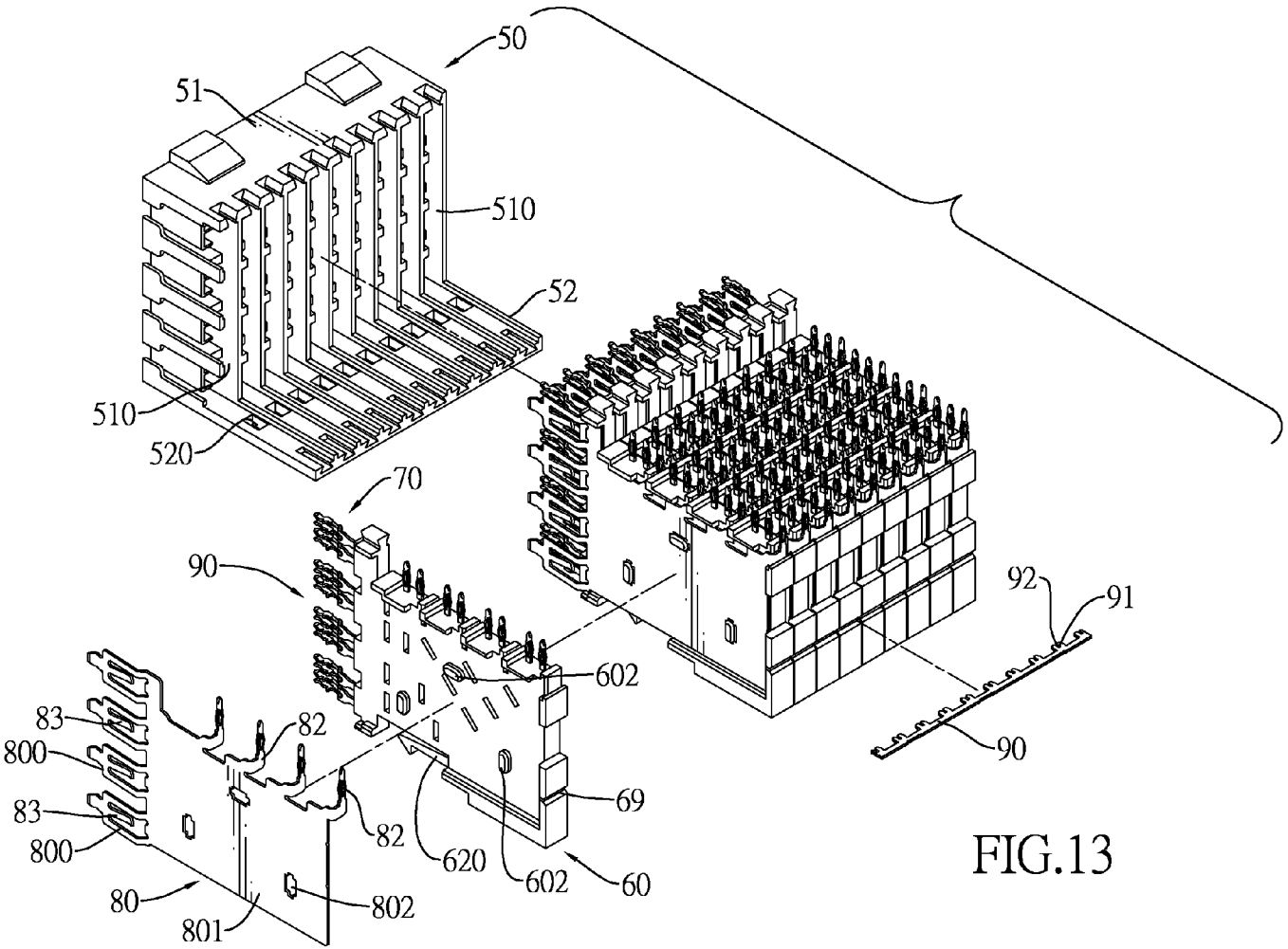
FIG. 13 is an exploded perspective view of the female connector in FIG. 1.
Figure 14:
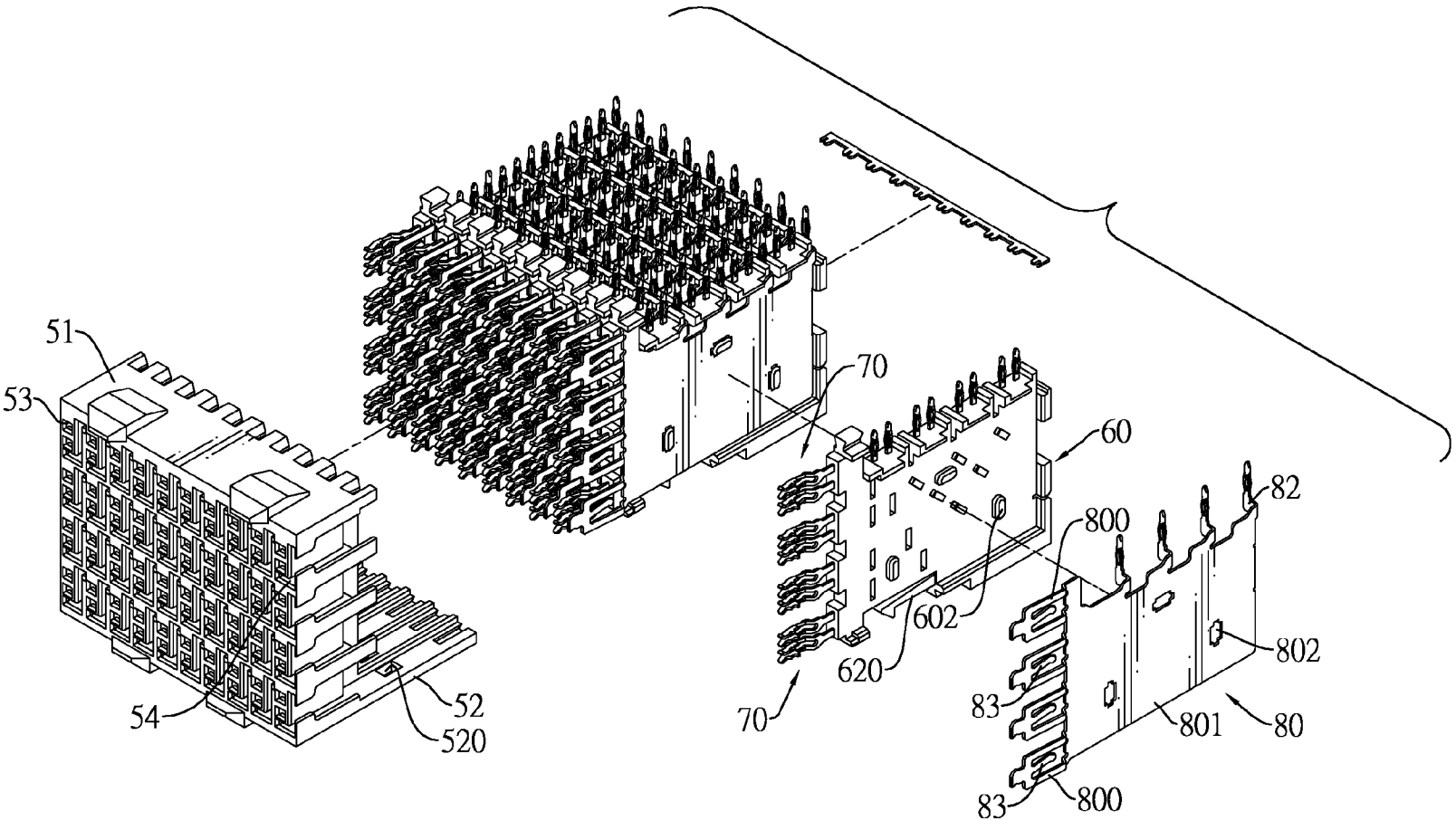
FIG. 14 is another exploded perspective view of the female connector in FIG. 13.
Figure 15:
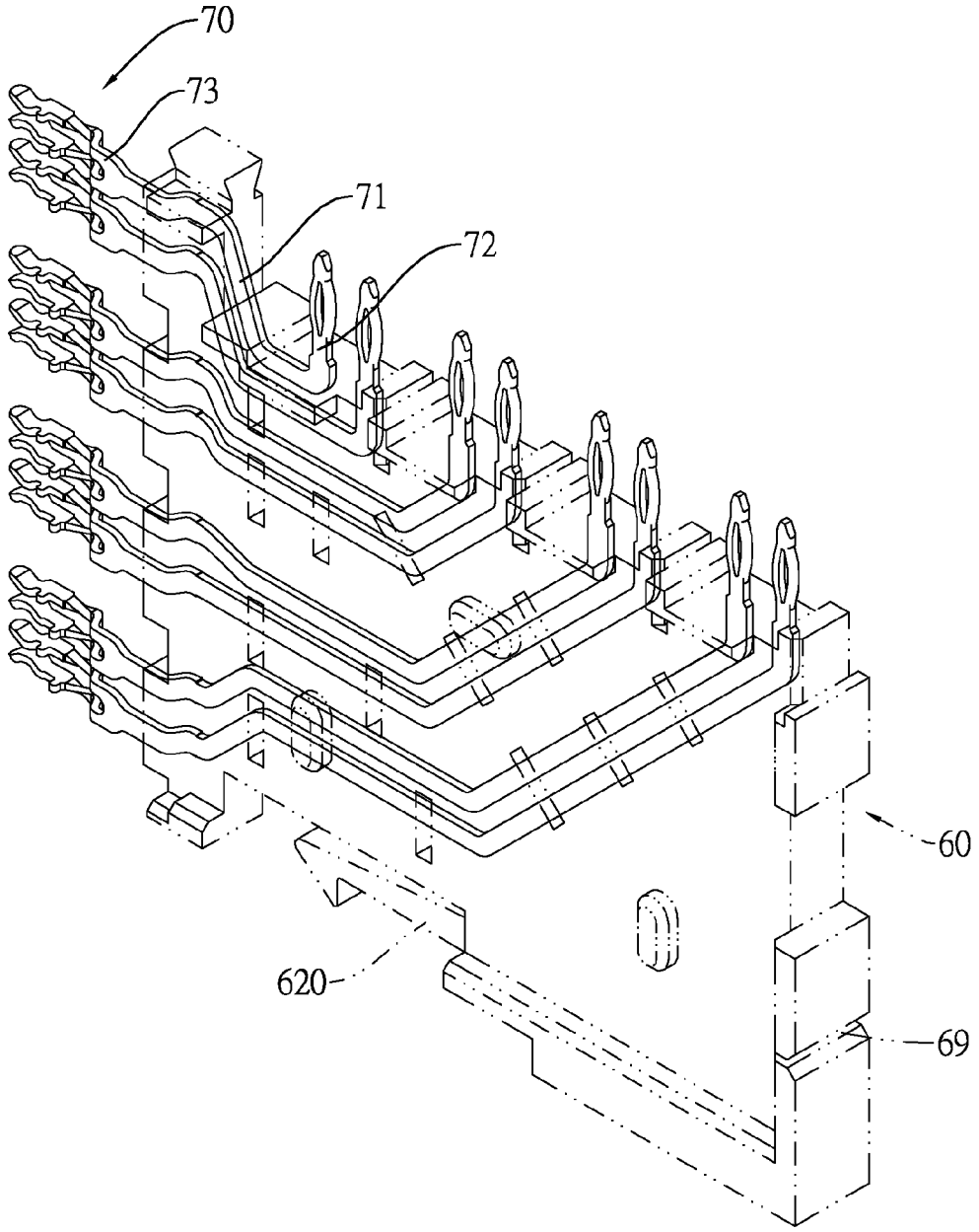
FIG. 15 is a perspective view of the second insulating base and signal transmission terminals of the female connector in FIG. 14.
Figure 16:
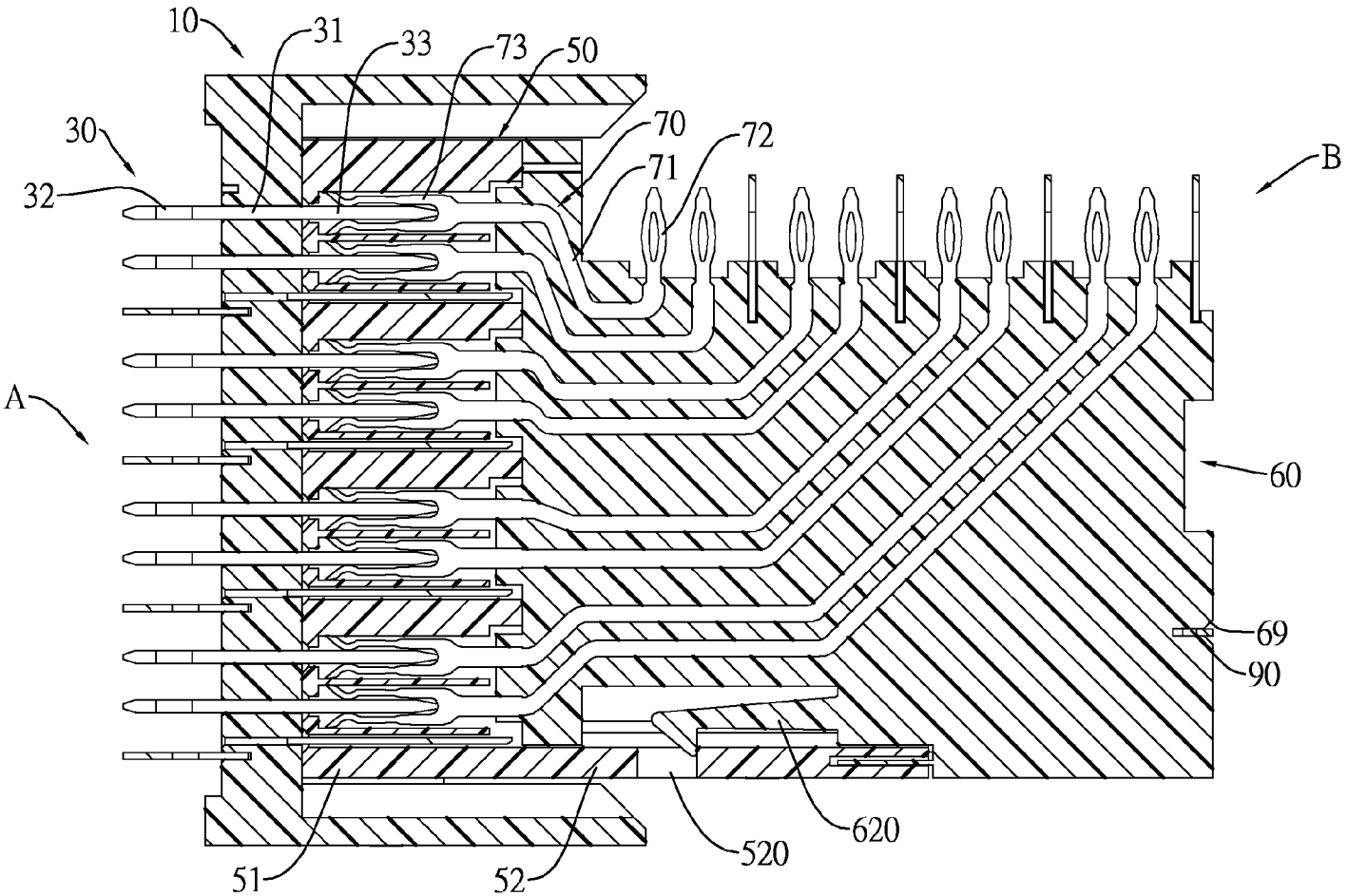
FIG. 16 is a cross sectional side view of the male connector and female connector in FIG. 1.

With reference to FIGS. 9 and 10, preferably, the insulating housing 10 further has multiple limiting slots 15 defined in the insulating housing 10 and communicating respectively with the grounding terminal holes 14. The first mounting segment 41 of each grounding terminal 400 has a limiting tab 45 formed on and protruding transversely from the first contacting segment 43 and mounted in one of the limiting slots 15 to improve the assembled structure of the insulating housing 10 and grounding terminals 400.

Preferably, the transverse extension segment 411 and the transverse positioning tab 431 of each grounding terminal 400 protrude along the same direction. The limiting tab 45 of each grounding terminal 400 protrudes along an opposite direction relative to the direction along which the transverse extension segment 411 and the transverse positioning tab 431 protrude so that each grounding terminal 400 has a substantial Z-shaped cross section when viewed from a front or rear end thereof.

Because each grounding terminal 400 is manufactured to form integrally, the grounding terminals 400 of each grounding terminal module 40 have a sufficiently small accumulative tolerance. Therefore, a total tolerance of all grounding terminals 400 is effectively suppressed within a reasonable small extent. The grounding terminals 400 may be easily assembled into the insulating housing 10 without incurring fabrication failure. The production rate of the male connector A is raised. Furthermore, because the grounding terminals 400 of each grounding terminal module 40 is formed into one piece, a robot arm of a fabricating machine simultaneously inserts multiple grounding terminals 400 into the insulating housing 10 in each terminal-inserting operation cycle, which greatly improves a speed of fabrication.

With further reference to FIGS. 13 to 16, the female connector B is connected detachably to the male connector A and has a first insulating base 50, multiple second insulating bases 60, multiple signal transmission terminal sets, multiple grounding plates 80 and a lateral supporting bar 90.

The first insulating base 50 has a bracket 51 and a tongue 52.

The bracket 51 has a bottom, multiple assembling slots 510, multiple signal holes 53 and multiple grounding holes 54. The assembling slots 510 are defined in the bracket 51 and arranged in a row. The signal holes 53 are defined through the bracket 51. The grounding holes 54 are defined through the bracket 51.

The tongue 52 is formed on and protrudes backward from the bottom of the bracket 51 and has a top and multiple locking holes 520 defined in the top and corresponding to the assembling slots 510.

The second insulating bases 60 are substantially rectangular and are mounted respectively in the assembling slots 510 of the first insulating base 50 and each second insulating base 60 has a bottom edge, a rear edge and a resilient hook 620 and may further have a notch 69 and multiple positioning protrusions 602.

The resilient hook 620 is formed on and protrudes forward from the bottom edge and hooks in one of the locking holes 520.

The notch 69 is defined in the rear edge of the second insulating base 60.

The positioning protrusions 602 are formed on and protrude transversely from the second insulating base 60.

The signal transmission terminal sets are mounted respectively on and correspond to the second insulating base 60 and each signal transmission terminal set has multiple signal transmission terminals 70 mounted on the second insulating base 60 and respectively extending in the signal holes 53 of the bracket 51 of the first insulating base 50. The signal transmission terminals 70 of all signal transmission terminal sets are arranged in an array. Each signal transmission terminal 70 has a mounting member 71, a press-fitting member 72 and a contacting member 73.

The mounting member 71 is mounted in a corresponding second insulating base 60.

The press-fitting member 72 is formed on and protrudes upward from the mounting member 71 out of the corresponding second insulating base 60.

The contacting member 73 may be forked, is formed on and protrudes forward from the mounting member 71 out of the corresponding second insulating base 60 and extends in one of the signal holes 53 of the first insulating base 50.

The grounding plates 80 are mounted respectively on and correspond to the second insulating bases 60, are arranged alternately with the second insulating bases 60, extend forward in the bracket 51 of the insulating base 50 and each grounding plate 80 has a mounting sheet 801, multiple press-fitting legs 82 and multiple contacting plates 800 and may further have multiple positioning holes 802.

The mounting sheet 801 is substantially rectangular, is mounted on a corresponding second insulating base 60 and has a front edge, a rear edge and a top edge.

The press-fitting legs 82 are formed on and protrude upward from the top edge of the mounting sheet 801.

The contacting plates 800 are formed on and protrude forward from the front edge of the mounting sheet 801, extend respectively in some of the grounding holes 54 of the bracket 51 of the first insulating base 50 and each contacting plate 800 has a resilient contacting tab 83 formed on the contacting plate 800.

The positioning holes 802 are defined transversely through the mounting sheet 801 and mounted respectively around the positioning protrusions 602 of a corresponding second insulating base 60.

The lateral supporting bar 90 is mounted in the notches 69 of the second insulating bases 60, clamps and connects to all grounding plates 80 and has a shaft and multiple clamps 91.

The clamps 91 are formed on the shaft and each clamp 91 has a clamping slot 92 defined in the clamp 91 and engaging the rear edge of the mounting sheet 801 of one of the grounding plates 80.

The first and second insulating bases 50, 60 firmly engage each other through the locking holes 520 and resilient hooks 620 to prevent inadvertent disassembly of the female connector B due to repetitive engagements and disengagements of the male and female connectors A, B.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A male connector comprising:

an insulating housing having a front and a rear;

multiple signal terminals arranged abreast, mounted through the insulating housing, extending out of the front of the insulating housing and arranged in an array; and multiple grounding terminal modules arranged abreast, mounted through the insulating housing and each grounding terminal module integrally formed into one piece and having multiple grounding terminals, wherein adjacent grounding terminals are connected integrally to each other so that the grounding terminals of each grounding terminal module are arranged in a line; and wherein each grounding terminal comprises:

a transverse extension segment formed on and protruding transversely from the grounding terminal; and a limiting tab formed on and protruding transversely from the grounding terminal along an opposite direction relative to a direction along which the transverse extension segment protrudes so that each grounding terminal has a substantial Z-shaped cross section when viewed from a front or rear end thereof.

2. The male connector as claimed in claim 1, wherein adjacent grounding terminals are connected integrally to each other through a connecting section.

3. The male connector as claimed in claim 2 further comprising a supporting crossbar clamping and connecting to all grounding terminal modules and comprising:

a bar; and multiple clamps formed on the bar and each clamp having a clamping slot defined in the clamp and engaging the connecting section of one of the grounding terminal modules.

4. The male connector as claimed in claim 3, wherein the insulating housing has multiple signal terminal holes and multiple grounding terminal holes defined through the insulating housing;

the signal terminals are mounted respectively and longitudinally through and correspond to the signal terminal holes; and the grounding terminals are mounted respectively and longitudinally through the grounding terminal holes of the insulating housing.

5. The male connector as claimed in claim 4, wherein each grounding terminal of each grounding terminal module has a first mounting segment mounted in one of the grounding terminal holes in the insulating housing, wherein the transverse extension segment is formed on and protrudes transversely from the first mounting segment;

a first press-fitting segment formed on and protruding longitudinally backward from the first mounting segment; and a first contacting segment formed on and protruding longitudinally forward from the first mounting segment.

6. The male connector as claimed in claim 5, wherein each grounding terminal hole of the insulating housing has an L-shaped cross section and a slit extending transversely from and communicating with the grounding terminal hole; and the first contacting segment of each grounding terminal has a transverse positioning tab being longitudinal, formed on and protruding transversely from the first contacting segment and mounted in the slit of one of the grounding terminals.

7. The male connector as claimed in claim 6, wherein the insulating housing has multiple limiting slots defined in the insulating housing and communicating respectively with the grounding terminal holes; and the limiting tab of each grounding terminal is mounted in one of the limiting slots.

8. The male connector as claimed in claim 7, wherein the transverse extension segment and the transverse positioning tab of each grounding terminal protrude along the same direction; and the limiting tab of each grounding terminal protrudes along an opposite direction relative to a direction along which the transverse positioning tab protrudes.

9. The male connector as claimed in claim 8, wherein each signal terminal comprises:

a second mounting section mounted in a corresponding signal terminal hole of the insulating housing;

a second press-fitting section formed on and protruding backward from the second mounting section; and a second contacting section formed on and protruding forward from the second mounting section.

10. A female connector corresponding to the male connector as claimed in claim 1, the female connector comprising:

a first insulating base comprising:

a bracket having a bottom and multiple assembling slots defined in the bracket and arranged in a row; and a tongue formed on and protruding backward from the bottom of the bracket;

multiple second insulating bases mounted respectively in the assembling slots of the first insulating base and each second insulating base having a bottom edge, a rear edge and a resilient hook formed on and protruding forward from the bottom edge and hooking in one of the locking holes;

multiple signal transmission terminal sets mounted respectively on and corresponding to the second insulating base and each signal transmission terminal set having multiple signal transmission terminals mounted on the second insulating base and respectively extending in the bracket of the first insulating base, wherein the signal transmission terminals of all signal transmission terminal sets are arranged in an array; and multiple grounding plates mounted respectively on and corresponding to the second insulating bases, arranged alternately with the second insulating bases and extending forward in the bracket of the insulating base.

11. The female connector as claimed in claim 10, wherein each grounding plate comprising:

a mounting sheet mounted on a corresponding second insulating base and having a front edge, a rear edge and a top edge;

multiple press-fitting legs formed on and protruding upward from the top edge of the mounting sheet; and multiple contacting plates formed on and protruding forward from the front edge of the mounting sheet and each contacting plate having a resilient contacting tab formed on the contacting plate.

12. The female connector as claimed in claim 11, wherein each second insulating base further has a notch defined in the rear edge of the second insulating base; and a lateral supporting bar is mounted in the notches of the second insulating bases, clamps and connects to all grounding plates and comprising:

a shaft; and multiple clamps formed on the shaft and each clamp having a clamping slot defined in the clamp and engaging the rear edge of the mounting sheet of one of the grounding plates.

13. The female connector as claimed in claim 12, wherein the bracket of the insulating bracket has multiple signal holes and grounding holes defined through the bracket;

the signal transmission terminals respectively extend in the signal holes of the bracket of the first insulating base; and the contacting plates of the grounding plates extend respectively in the grounding holes of the bracket of the first insulating base.

14. The female connector as claimed in claim 13, wherein each second insulating base has multiple positioning protrusions formed on and protruding transversely from the second insulating base; and each grounding plate has multiple positioning holes defined transversely through the mounting sheet and mounted respectively around the positioning protrusions of a corresponding second insulating base.

15. The female connector as claimed in claim 14, wherein each signal transmission terminal comprising:

a mounting member mounted in a corresponding second insulating base;

a press-fitting member formed on and protruding upward from the mounting member out of the corresponding second insulating base; and a contacting member formed on and protruding forward from the mounting member out of the corresponding second insulating base and extending in one of the signal holes of the first insulating base.

* * * * *